United States Patent [19]

Baudoin et al.

[11] Patent Number: 4,624,217

[45] Date of Patent: Nov. 25, 1986

[54] STEAM GENERATORS HAVING A CENTRAL BODY OF THE SODIUM-WATER TYPE

[75] Inventors: André Baudoin, Marly le Roi; René Traiteur, Ris Orangis, both of France

[73] Assignee: Novatome, Le-Plessis-Robinson, France

[21] Appl. No.: 728,419

[22] Filed: Apr. 29, 1985

[30] Foreign Application Priority Data

May 4, 1984 [FR] France ..... 84 06942

[51] Int. Cl.[4] ..... F22B 1/02

[52] U.S. Cl. ..... 122/32; 122/504; 165/134.1

[58] Field of Search ..... 122/32, 33, 504; 165/134 R; 376/370

[56] References Cited

U.S. PATENT DOCUMENTS

| | | | |
|---|---|---|---|
| 3,279,439 | 10/1966 | Ammon | 122/34 |
| 3,924,675 | 12/1975 | Essebaggers | 165/134 |
| 4,163,470 | 8/1979 | Johnsen et al. | 122/32 X |
| 4,307,685 | 12/1981 | Robin et al. | 122/32 |
| 4,469,051 | 9/1984 | Malaval | 122/32 X |
| 4,515,109 | 5/1985 | Jullien | 122/32 |

FOREIGN PATENT DOCUMENTS

| | | |
|---|---|---|
| 0070775 | 7/1981 | European Pat. Off. . |
| 0089869 | 9/1983 | European Pat. Off. . |
| 2295388 | 7/1976 | France . |
| 2363772 | 3/1978 | France . |

*Primary Examiner*—Edward G. Favors

*Attorney, Agent, or Firm*—Pollock, Vande Sande & Priddy

[57] ABSTRACT

According to the invention, the central body (10) of the steam generator filled with liquid sodium in its upper and middle part comprises in its lower part, on one hand, a crowned end wall (23) under which an inert gas is injected for forming a pocket (24) which contains a small volume of gas and defines a gas-liquid separation surface (25) for the reflection and the attenuation of a pressure wave in the event of a sodium-water reaction, and, on the other hand, a spider element (11) which connects the lower end of the central body (10) to an end element (16) provided with a frustoconical portion (17) which extends with an annular clearance into the outlet pipe (5) for the liquid sodium which has travelled through the tube bundle (7). Application in particular to nuclear power stations.

5 Claims, 3 Drawing Figures

STEAM GENERATORS HAVING A CENTRAL BODY OF THE SODIUM-WATER TYPE

FIELD OF THE INVENTION

The present invention relates to an improvement in steam generators of the sodium-water type used in particular in nuclear power stations.

BACKGROUND

In electric power stations, a boiler supplies heat to the fluid of a circuit in a closed loop, this heated fluid flowing then in a steam generator so as to give up its heat to the water which is converted into steam, the steam being then sent to the turbines of the power station.

Some nuclear power stations, in particular of the fast neutron type, employ as fluid for transporting heat from the boiler to the steam generator, liquid sodium. In this case, the steam generator comprises a heat exchanger whose primary circuit encloses the liquid sodium and whose secondary circuit encloses water converted into steam.

These steam generators comprise a cylindrical shell which has a vertical axis and is closed by crowned or dished end walls in which is disposed the tube bundle. This bundle, when it is formed by tubes wound helically, occupies only a part of the cross-section of the internal volume of the shell and extends only in a part of the height of the shell. Formed above the bundle is a region in which at least one heated liquid sodium supply pipe opens, whereas in the lower part of the steam generator there is provided a cooled liquid sodium outlet pipe.

The liquid sodium flows, between its inlet and outlet in the shell of the steam generator, in contact with the outer surface of the tubes of the tube bundle in which flows water which is converted into steam by heat exchange with the liquid sodium.

The central part of the inner volume of the shell is occupied by a cylindrical central body closed in its upper part, coaxial with the shell of the steam generator, from the lower part of the latter to the upper region in which the liquid sodium arrives. The tube bundle occupies the peripheral part of the internal volume of the shell around the central body throughout the height of the latter, except for its lower part in which openings permit the outlet of the liquid sodium after it has passed through the bundle without creating disturbances in the flow in the region of the outlet loops of the tubes of the bundle.

The supply and flow of the sodium in the steam generator are regulated in such manner that the upper level of this sodium in the shell of the generator is located a little above the inlet of the sodium in the upper part of the shell. The space between the upper level of sodium and the upper end wall of the generator is filled with a neutral gas such as argon.

In such steam generators, precautions must be taken to avoid any contact between the liquid sodium of the primary circuit and the water of the secondary circuit. Indeed, it is known that the mixture of sodium and water at high temperature produces very violent chemical reactions with the emanation of gas and a sudden increase in the pressure prevailing in the liquid sodium. These accidental sudden reactions, which may be likened to an explosion inside the generator, can result in partial deterioration of certain components, but also, owing to the propagation of the pressure wave in the piping of the secondary circuit, can damage the intermediate exchangers or circulation pumps or any installation located in this secondary circuit. It is therefore necessary to encourage the propagation of the pressure waves toward a free level of the liquid sodium where these waves are damped.

Up to the present time, in the event of a sodium-water reaction, the pressure wave which travels upwardly receives a considerable damping or absorption on the upper free surface of the sodium, on the other hand, that which travels downwardly does not encounter such a free surface.

SUMMARY OF THE INVENTION

An object of the present invention is to overcome mainly these various drawbacks while permitting the outlet of the liquid sodium which has travelled through the tube bundle without causing swirling flows in the region of the outlet loops of the tubes.

According to the invention, the central body filled with liquid sodium in its upper and middle part comprises in its lower part, on one hand, a crowned or dished end wall under which is injected an inert gas for the purpose of forming a pocket which contains a small volume of gas and defines a gas-liquid separation surface for the reflection and the attenuation of a pressure wave in the event of a sodium-water reaction, and, on the other hand, a spider element which connects the lower end of the central body to an end element provided with a frustoconical portion fitting with an annular clearance in a pipe for the outlet of the liquid sodium which has travelled through the tube bundle.

BRIEF DESCRIPTION OF THE DRAWINGS

There will now be described, by way of a non-limiting example, a preferred embodiment of the invention with reference to the accompanying drawings, in which.

DETAILED DESCRIPTION

Figure 1:
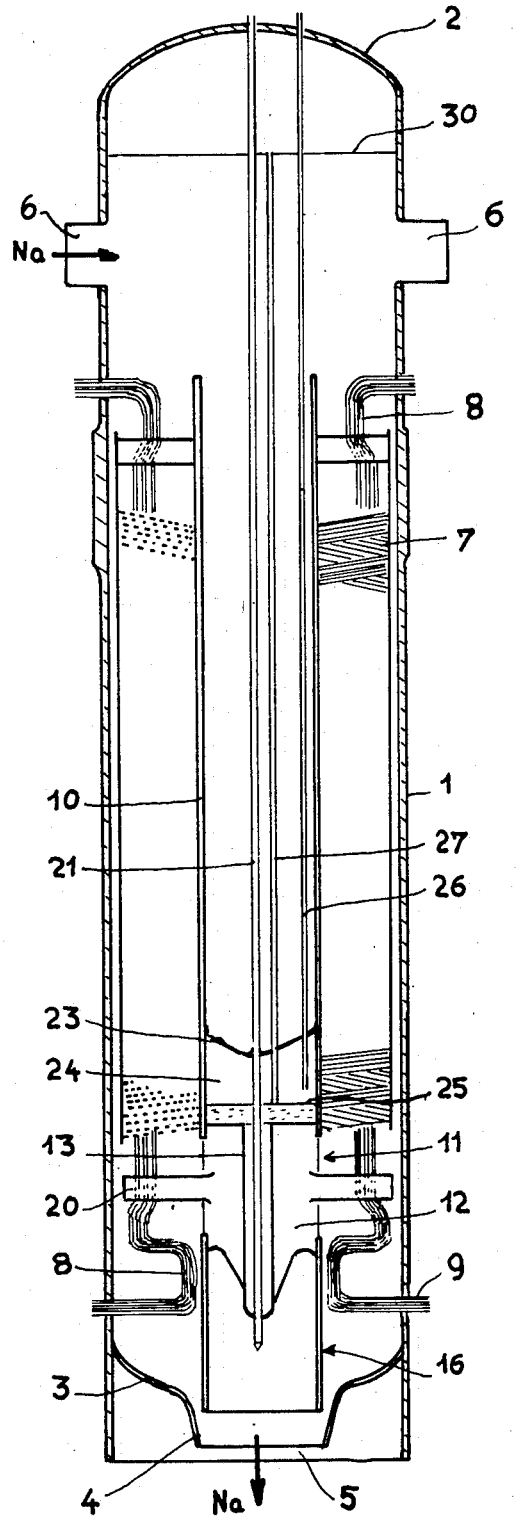
FIG. 1 is a sectional view of the steam generator in a vertical plane of symmetry.

The steam generator comprises a cylindrical shell 1 of great length relative to its diameter and disposed vertically, this shell being filled with circulating liquid sodium constituting the primary circuit. This shell 1 is closed by two crowned or dished end walls 2 and 3 at its upper and lower ends respectively.

The lower end wall 3 is provided with a slightly conical extension 4 forming a sodium outlet pipe 5. The liquid sodium supplied to the steam generator is introduced in the inlet chamber through orifices 6 which extend radially of the shell 1, and then flows downwardly inside the shell and reaches the outlet region located in the lower part of the steam generator from which it is discharged through the pipe 5.

Fixed inside the shell 1 is a hollow cylindrical body 10 coaxial with this shell. The steam generator comprises a secondary circuit formed by a tube bundle 7 wound helically in the annular space between the central body 10 and the shell 1. This helical bundle terminates in expansion loops 8, each tube 9 then passing radially through the outer shell. The water is introduced through the lower part of the tubes 9 and issues from the upper part in the form of steam.

Figure 2:
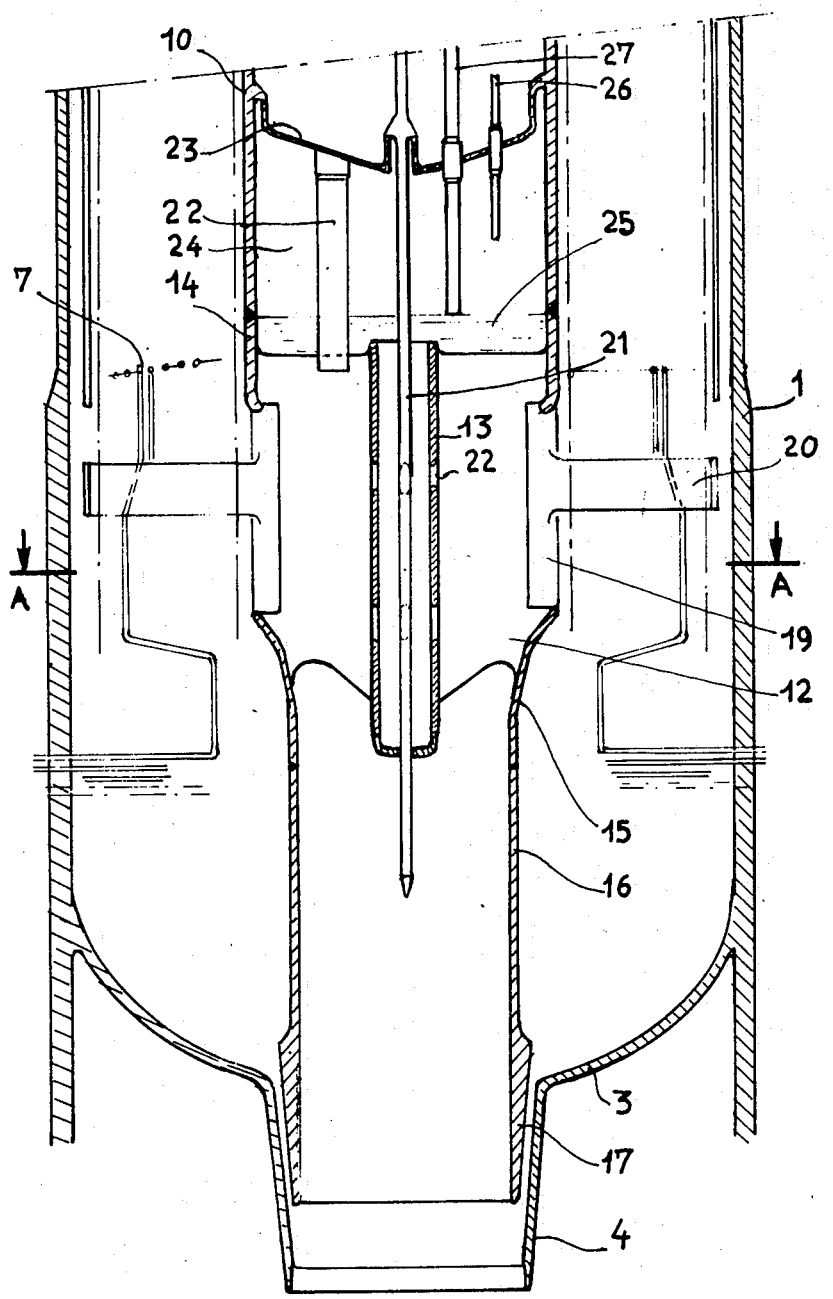
FIG. 2 is a sectional view to an enlarged scale of the lower part of the steam generator.
Figure 3:
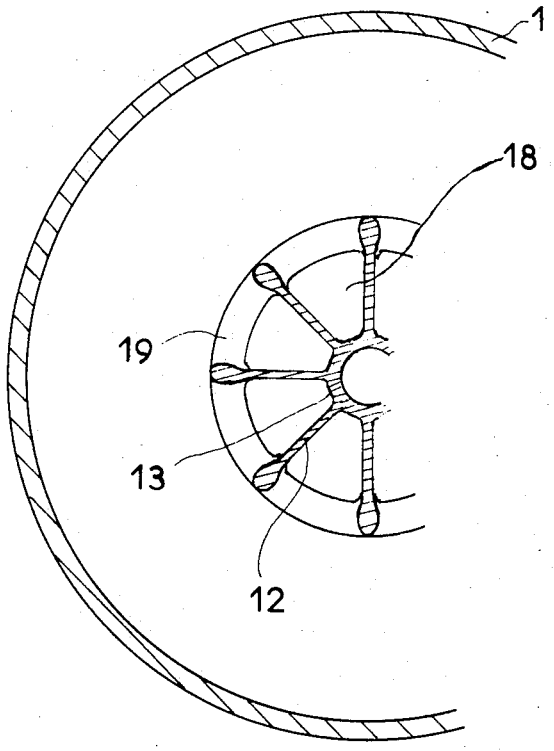
FIG. 3 is a sectional view taken on line A—A of FIG. 2.

With reference more particularly to FIGS. 2 and 3, there is shown a spider element 11 formed by eight radially extending fins 12 and including a small central tube 13 which is welded to the lower part of the central body 10 by means of an upper flange 14. This spider element 11 also has a lower flange 15 to which is welded an end element 16 which terminates in a frustoconical portion 17 extending into the conical pipe 5 with a rather large clearance. This clearance permits a certain flow of sodium, about 10%, between the shell 1 and the end of the cylindrical body so as to scavenge the expansion loops 8 and thereby avoid any harmful stagnant sodium. The fins 12 therefore define eight sectors 18 which, in the region of the end of the helical bundle 7 and of the start of the loops 8, communicate each through an opening 19 with the peripheral space of the steam generator around the central body 10. The spider element 11, which is for example made in the foundry, also includes in the middle of each fin 12, an arm 20 adapted to center the central body 10 relative to the outer shell and maintain this body in position in the event of radial stresses, for example occurring in the event of an earthquake. There are therefore as many arms as there are fins. A level probe 21 maintained by the small central tube 13 is mounted on the axis of the cylindrical body 10.

Slightly above the upper flange 14 of the spider element 11, the cylindrical body 10 is closed by a crowned or dished end wall 23 so as to constitute a pocket 24 containing a small volume of inert gas, for example argon, and defining a gas-liquid separation surface 25; the upper part of the cylindrical body 10 above this crowned end wall is filled with liquid sodium. The central part of the crowned end wall 23 has the level proble 21 extending therethrough. A small conduit 26 supplies to the pocket 24 the required volume of gas, and a tube 27 extends between the separation surface 25 and the free upper level 30 of sodium. This tube 27 enables a constant level of sodium to be maintained in the gas-filled pocket 24, any excess escaping to the upper free level 30 of the steam generator. The crowned end wall 23 also has a tube 22 for draining the central body 10, in particular in the event of a rapid draining of the steam generator.

Before the steam generator is put into service, the shell 1 of the latter is filled with liquid sodium up to the level 30. Argon is then supplied to the interior of the pocket 24 through the small conduit 26. The sodium level in the pocket 24 is established at the level of the tube 27.

If a leakage occurs in the steam generator just described, in the tube bundle conveying the water, the pressure wave following on the violent sodium-water reaction very rapidly encounters a free sodium-argon level so that it is considerably damped or absorbed within the very interior of the steam generator. Indeed, the pressure wave which travels upwardly encounters the upper free level 30 where it is considerably damped. The same is true in respect of the downwardly travelling pressure wave, since it very rapidly encounters the gas-liquid separation surface 25 where it is also damped or absorbed, owing to the elasticity of the gas pocket 24, so that this pressure wave is not propagated in large proportions through the sodium outlet piping toward the other apparatus disposed in this circuit, i.e. mainly the circulation pumps and above all the intermediate exchangers.

Further, in the event of leakage of a tube of the bundle, the level probe permits, with other special equipment, the detection of the region in which the leakages occur by the consequential lowering of the level of the sodium of the steam generator.

It can be seen that the main advantage of the device according to the invention is to permit a rapid damping or absorption of the pressure waves when the latter occur, irrespective of their direction or propagation. This result is obtained by a simple design of the devices producing a free level at the base of the steam generator.

The scope of the invention is not intended to be limited to the embodiment just described, since it encompasses all variants, and modifications may be made in points of detail without departing from the scope of the invention defined in the claims. For example, the arrangements particular to the present invention may be applied to a steam generator whose tubes of the secondary circuit would be disposed in a manner other than helically.

What is claimed is:

1. In a steam generator of the sodium-water type, in particular for nuclear power stations, comprising:

a cylindrical shell having a vertical axis, two crowned end walls at an upper end and lower end of the shell for closing the shell, a liquid sodium filling the shell and a slightly conical extension on the lower end wall forming a sodium outlet pipe, a hollow central body open in an upper part thereof and disposed inside and coaxially with the cylindrical shell, and a secondary circuit comprising a tube bundle for the circulation of water and extending in an annular space between the central body and the cylindrical shell, the improvement wherein the central body filled with liquid sodium in an upper and middle part thereof includes in a lower part thereof a crowned end wall, means for injecting an inert gas below the crowned end wall so as to constitute a pocket which contains a small volume of gas and defines a gas-liquid separation surface for the reflection and the attenuation of a pressure wave in the event of a sodium-water reaction, the central body further including, in the lower part thereof, a spider element which connects a lower end of the central body to an end element provided with a frustoconical portion extending with an annular clearance into the outlet pipe for the liquid sodium which has travelled through the tube bundle.

2. The improvement according to claim 1, wherein the pocket containing a small volume of gas includes a small gas supply conduit and a vertical tube connecting said pocket to the upper part of the steam generator for the purpose of discharging gas in excess and maintaining the gas-sodium level constant.

3. The improvement according to claim 1, wherein the spider element comprises radially extending fins, a small central tube carried by the fins for maintaining a level probe, and an upper flange and a lower flange which are respectively welded to the central body and to said end element.

4. The improvement according to claim 3, wherein the radially extending fins define in the spider element sectors each communicating through an opening with the annular space between the central body and the shell.

5. The improvement according to claim 4, wherein each radially extending fin is extended in a part of its height by arms substantially to the shell for the centering and radial maintenance of the central body relative to the shell.

* * * * *